US009650826B2

(12) United States Patent
Potter

(10) Patent No.: US 9,650,826 B2
(45) Date of Patent: May 16, 2017

(54) HINGED VEHICLE DOOR OPERATING MECHANISM HAVING MULTIPLE SLIDES FOR INCREASING TORQUE DURING OPERATION

(71) Applicant: Ford Global Technologies, LLC, Dearborn, MI (US)

(72) Inventor: Timothy J. Potter, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 3 days.

(21) Appl. No.: 14/728,316

(22) Filed: Jun. 2, 2015

(65) Prior Publication Data

US 2016/0356071 A1 Dec. 8, 2016

(51) Int. Cl.

| | |
|---|---|
| ***E05F 15/02*** | (2006.01) |
| ***E05F 15/614*** | (2015.01) |
| ***E05D 15/00*** | (2006.01) |
| ***E05F 15/616*** | (2015.01) |
| ***E05F 15/63*** | (2015.01) |
| ***E05D 7/00*** | (2006.01) |

(52) U.S. Cl.

CPC ..... *E05F 15/614* (2015.01); *E05D 7/00* (2013.01); *E05D 15/00* (2013.01); *E05F 15/616* (2015.01); *E05F 15/63* (2015.01); *E05F 2015/631* (2015.01)

(58) Field of Classification Search

CPC ..... E05F 15/614; E05F 15/616; E05F 15/63; B60J 5/04; E05D 15/00; E05D 7/00

USPC ..... 49/333, 334, 335, 338

See application file for complete search history.

(56) References Cited

U.S. PATENT DOCUMENTS

| | | | | |
|---|---|---|---|---|
| 3,002,581 | A * | 10/1961 | Deibel | E05F 15/47 137/627.5 |
| 3,061,362 | A * | 10/1962 | Maruyama | E05F 15/47 296/146.4 |
| 3,141,662 | A * | 7/1964 | Wise | E05F 15/63 475/153 |
| 3,398,484 | A * | 8/1968 | Katsumura | E05F 15/622 318/268 |
| 3,653,154 | A * | 4/1972 | Hayday | E05F 15/63 192/45.017 |

(Continued)

FOREIGN PATENT DOCUMENTS

| | | |
|---|---|---|
| CA | 201810160 U | 4/2011 |
| GB | 620336 A | 3/1949 |

*Primary Examiner* — Jerry Redman

(74) *Attorney, Agent, or Firm* — Jason C. Rogers; Price Heneveld LLP

(57) ABSTRACT

A vehicle door assembly includes a vehicle door having a door cavity defined between outer and inner panels. The door is rotationally operable about a door hinge. A first slide is coupled to the vehicle door. A rotating bar is slidably coupled to the first slide and is operable about a bar hinge between door-closed and door-open positions. The bar hinge is coupled to the vehicle frame and is distal from the door hinge. An actuator includes a drive portion coupled to a drive mechanism that rotates the actuator about a drive shaft and an idler portion rotationally coupled to the drive portion at an actuator pivot. Operation of the drive portion slidably operates an actuator end along a second slide defined by the rotating bar between a high-torque position that corresponds to the door-closed position and a low-torque position that corresponds to the door-open position.

11 Claims, 10 Drawing Sheets

(56) References Cited

U.S. PATENT DOCUMENTS

| | | | | | |
|---|---|---|---|---|---|
| 3,886,425 | A | | 5/1975 | Weiss | |
| 4,121,382 | A | * | 10/1978 | Dietrich | E05F 15/614 49/280 |
| 4,183,177 | A | * | 1/1980 | Kurdziel | E05B 77/48 49/25 |
| 4,433,505 | A | | 2/1984 | Viner | |
| 4,644,693 | A | * | 2/1987 | Wang | E05F 15/619 49/280 |
| 5,369,911 | A | * | 12/1994 | Fortunato | E05F 5/025 49/25 |
| 6,773,047 | B2 | | 8/2004 | Gruber | |
| 7,500,711 | B1 | | 3/2009 | Ewing et al. | |
| 7,654,600 | B2 | | 2/2010 | Stratten | |
| 7,971,393 | B2 | * | 7/2011 | Gao | E05F 15/60 16/290 |
| 9,068,388 | B2 | * | 6/2015 | Costigan | E05F 5/06 |
| 9,080,363 | B2 | * | 7/2015 | Reed | E05F 5/025 |
| 9,174,517 | B2 | * | 11/2015 | Scheuring | B60J 5/047 |
| 9,353,566 | B2 | * | 5/2016 | Miu | E05F 15/611 |
| 2007/0175099 | A1 | * | 8/2007 | Kachouh | E05F 15/622 49/340 |
| 2008/0295408 | A1 | | 12/2008 | Heissler | |
| 2008/0309120 | A1 | * | 12/2008 | Kohlstrand | E05D 11/1007 296/146.11 |

* cited by examiner

HINGED VEHICLE DOOR OPERATING MECHANISM HAVING MULTIPLE SLIDES FOR INCREASING TORQUE DURING OPERATION

FIELD OF THE INVENTION

The present invention generally relates to vehicle door mechanisms, and more specifically, a vehicle door operating mechanism having multiple slides for increasing torque during operation of the mechanism.

BACKGROUND OF THE INVENTION

Various automobiles include doors having automatic door openers for sliding doors and also for hinged doors. Such openers typically include motorized assemblies that can take up large amounts of space in and around the door assembly.

SUMMARY OF THE INVENTION

According to one aspect of the present invention, a vehicle door assembly includes a vehicle door having an outer panel and an inner panel, wherein a door cavity is defined between the outer and inner panels, and wherein the vehicle door is rotationally operable about a door hinge coupled to a vehicle frame. A first slide is coupled to a portion of the vehicle door. A rotating bar is slidably coupled at a first bar end to the first slide between a plurality of first slide positions and operable at a second bar end about a bar hinge between door-closed and door-open positions, wherein the bar hinge is coupled to the vehicle frame and positioned distal from the door hinge. A second slide is at least partially defined by the rotating bar. An actuator having a drive portion is coupled to a drive mechanism that rotates the actuator about a drive shaft. The actuator also includes an idler portion rotationally coupled to the drive portion at an actuator pivot, wherein the operation of the drive portion slidably operates an actuator end along the second slide between a high-torque position that corresponds to the door-closed position of the rotating bar and a low-torque position that corresponds to the door-open position of the rotating bar.

According to another aspect of the present invention, a vehicle door operator includes a door having a first slide, a rotating bar defining a second slide and extending between a vehicle frame and the first slide and an actuator coupled with a drive mechanism. Rotation of the actuator causes an end of the actuator to slide along the second slide thereby causing the rotating bar to rotate and slide along the first slide to rotate the door about a door hinge.

According to another aspect of the present invention, a vehicle door operator includes a rotating bar coupled with a door at a first carriage operable along a first slide between door-closed and door-open positions. An actuator operably extends between the door and a second carriage slidably operable along the rotating bar between a high-torque position that corresponds to the door-closed position and a low-torque position that corresponds to the door-open position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
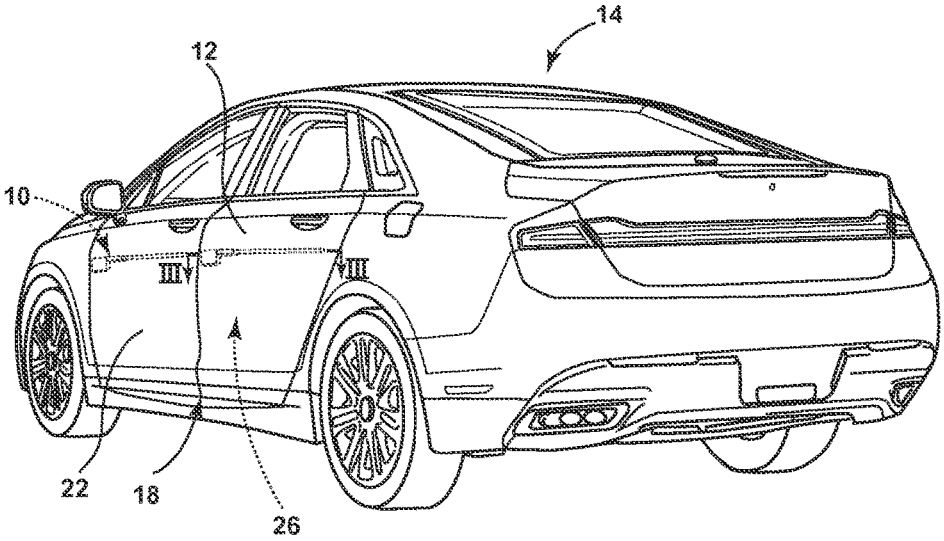
FIG. 1 is a side perspective view of a vehicle incorporating an embodiment of the multiple slide hinged door operator with the doors in a closed position.
Figure 2:
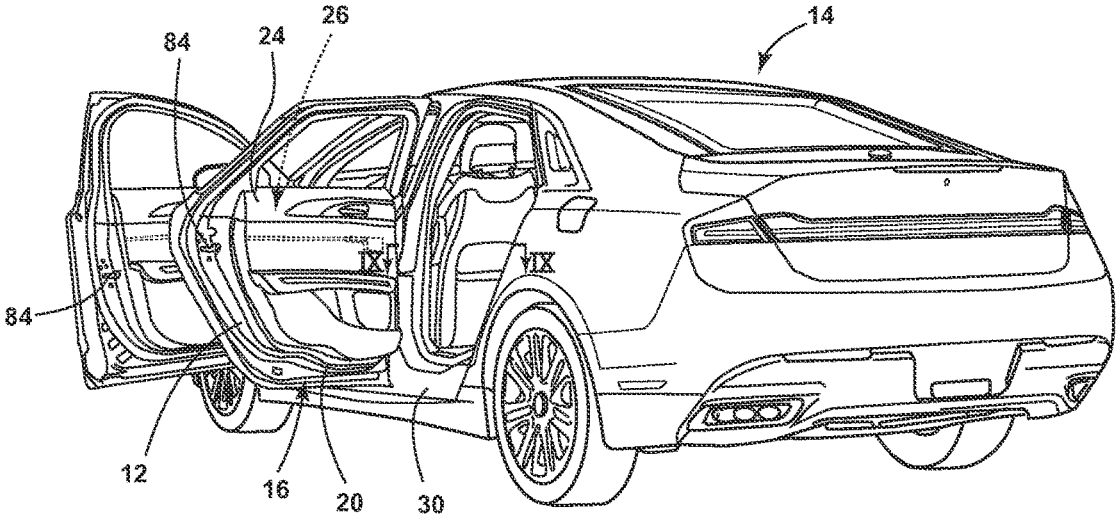
FIG. 2 is a side perspective view of the vehicle of FIG. 1 with the doors moved to an open position.
Figure 3:
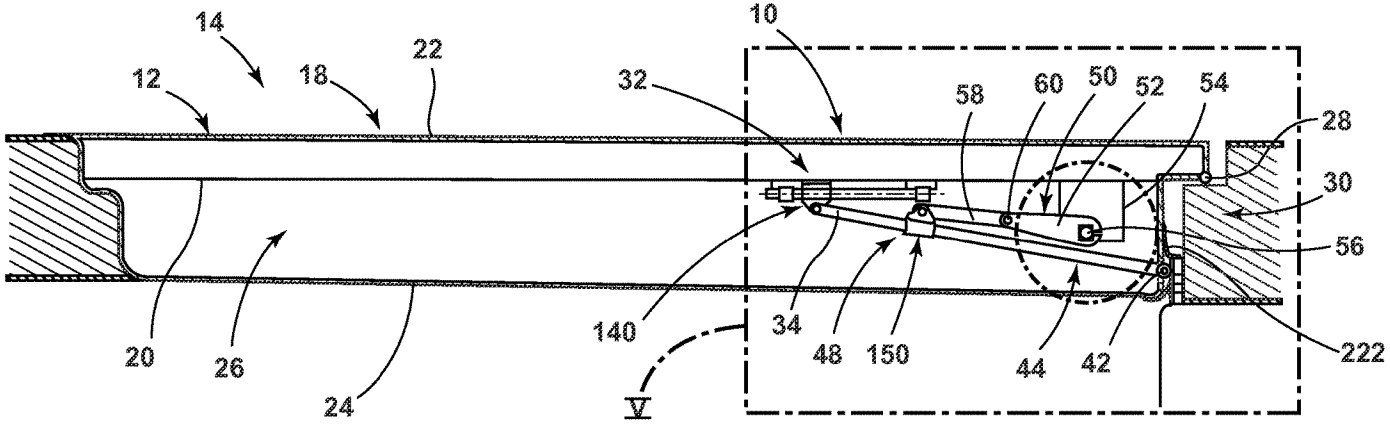
FIG. 3 is a cross-sectional view of the vehicle of FIG. 1 taken along line III-III and illustrating the multiple slide hinged door operator in a door closed position.
Figure 4:
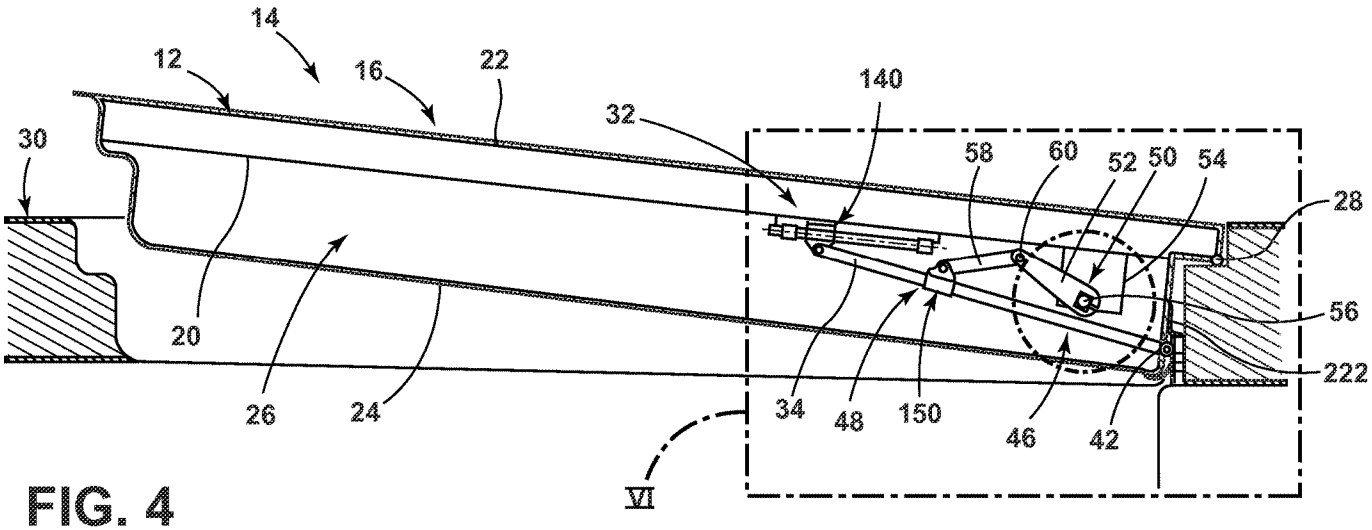
FIG. 4 is a cross-sectional view of the vehicle door of FIG. 3 illustrating the door moved to a slightly open position.
Figure 5:
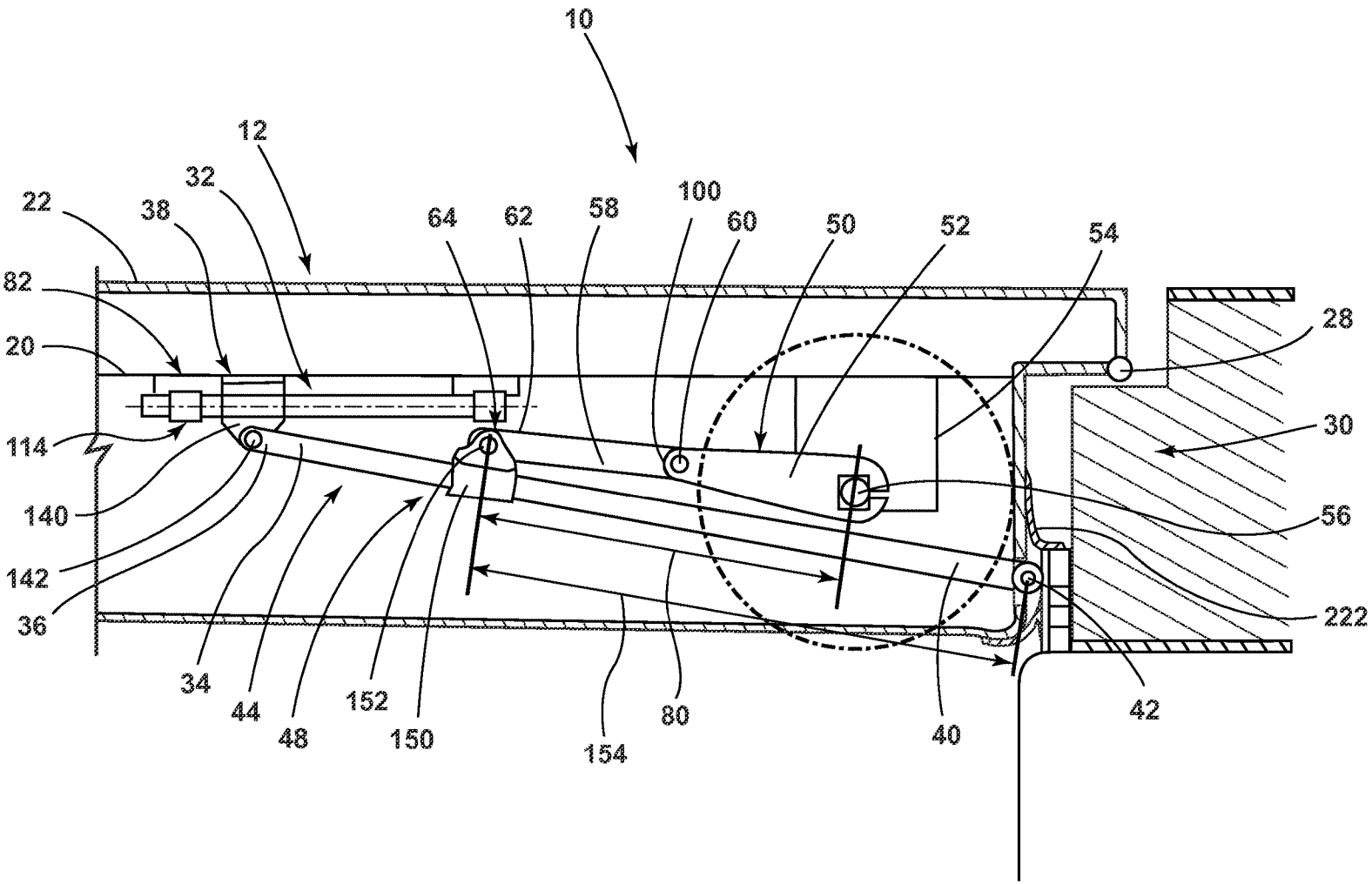
FIG. 5 is a detail cross-sectional view of the vehicle door of FIG. 3 taken at area V-V.
Figure 6:
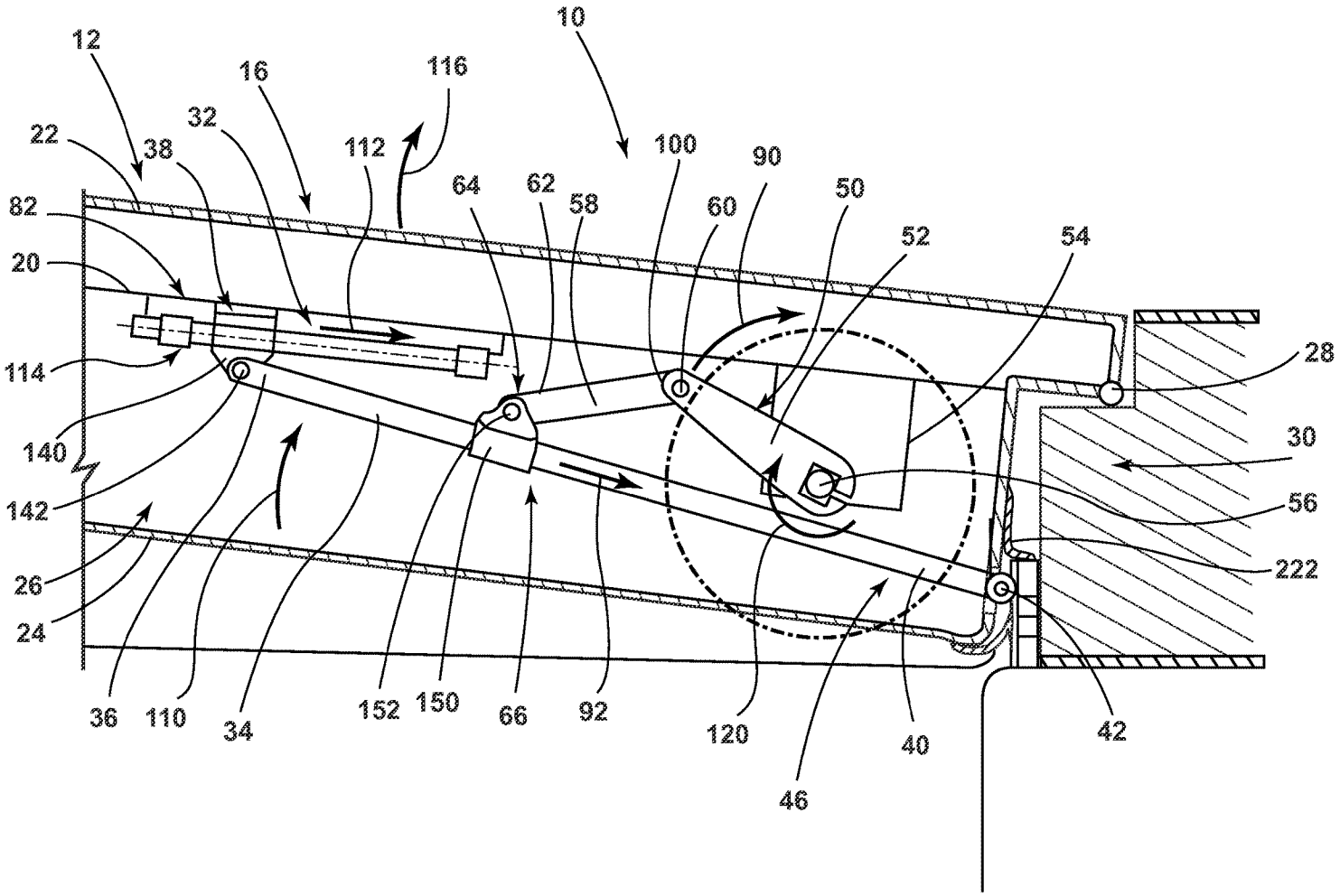
FIG. 6 is a detail cross-sectional view of the vehicle door of FIG. 4 taken at area VI-VI.
Figure 7:
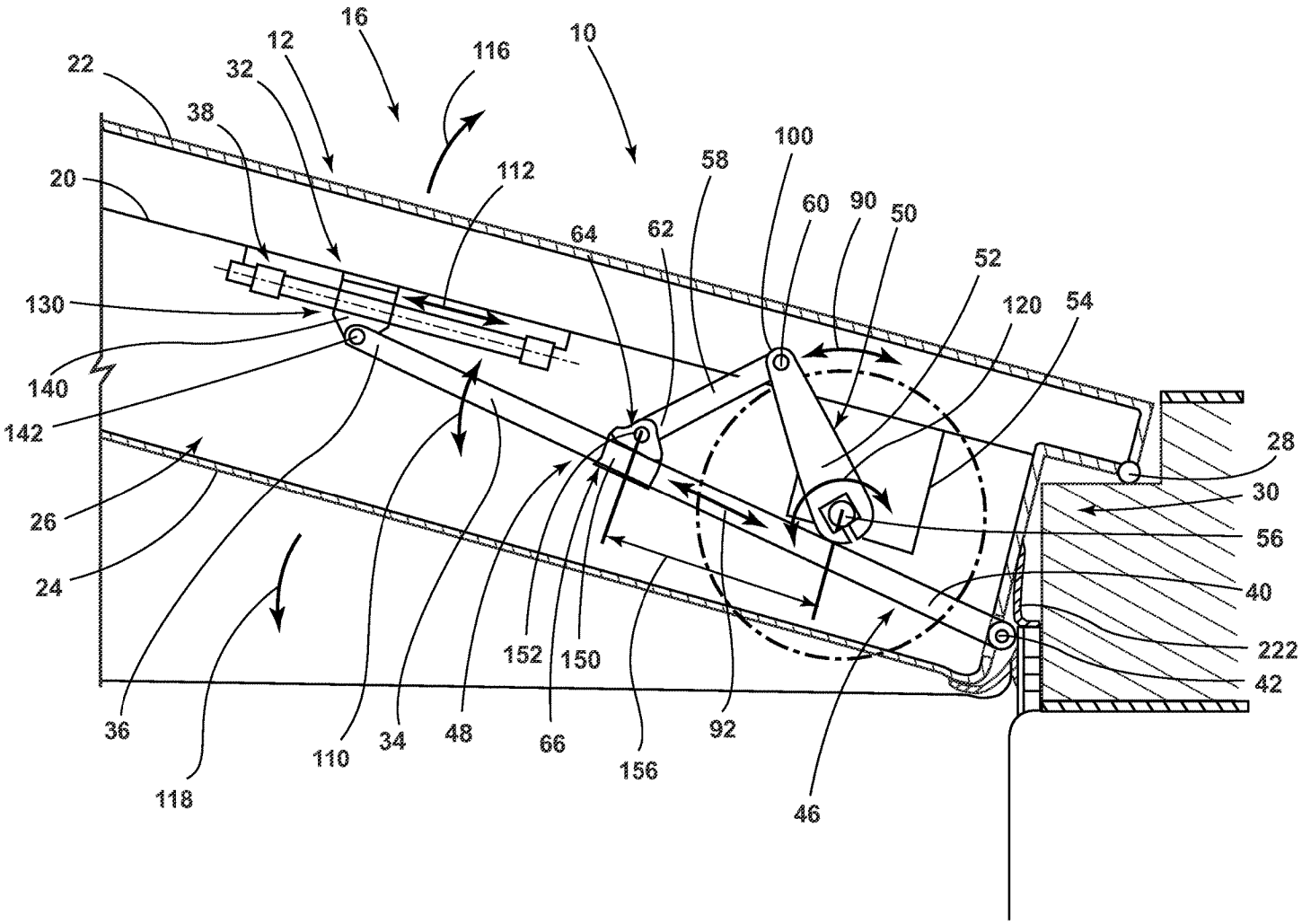
FIG. 7 is a cross-sectional view of the vehicle door of FIG. 6 showing the door in a slightly more open position.
Figure 8:
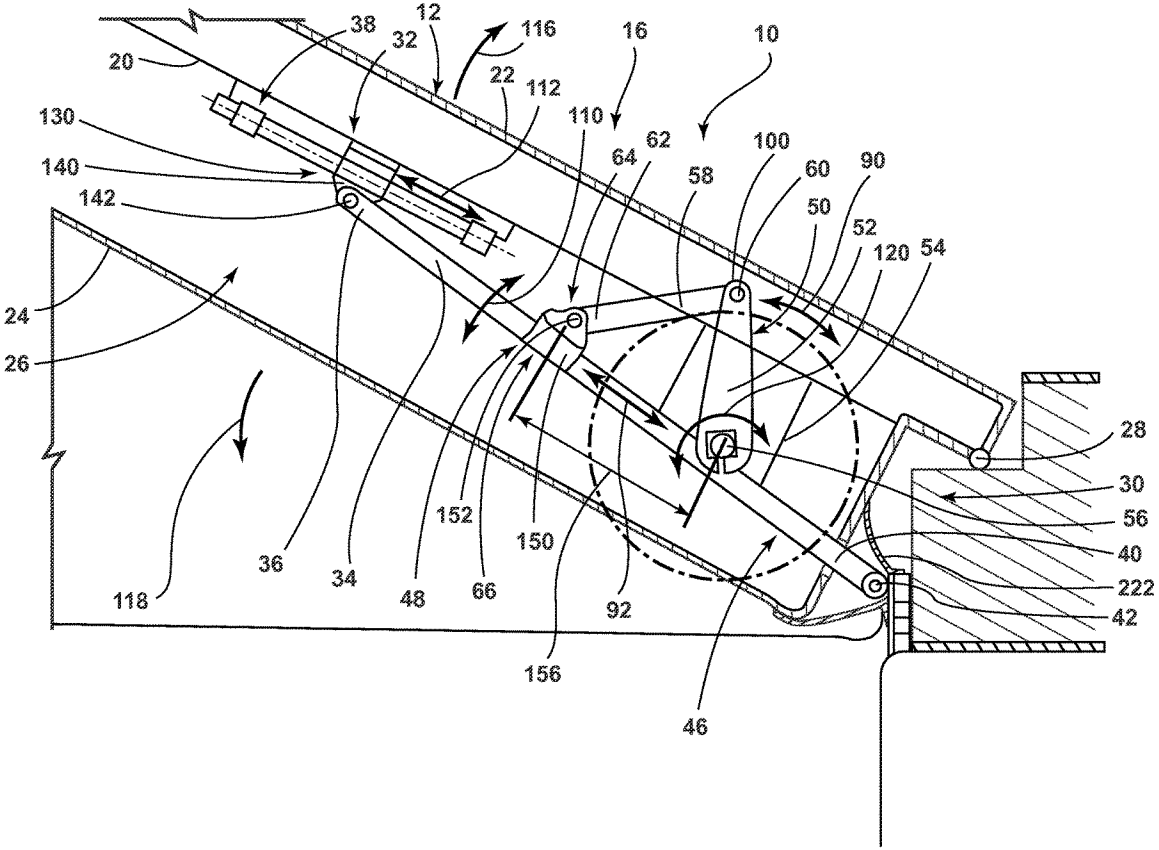
FIG. 8 is a cross-sectional view of the vehicle door of FIG. 7 showing the door in a further opened position.
Figure 9:
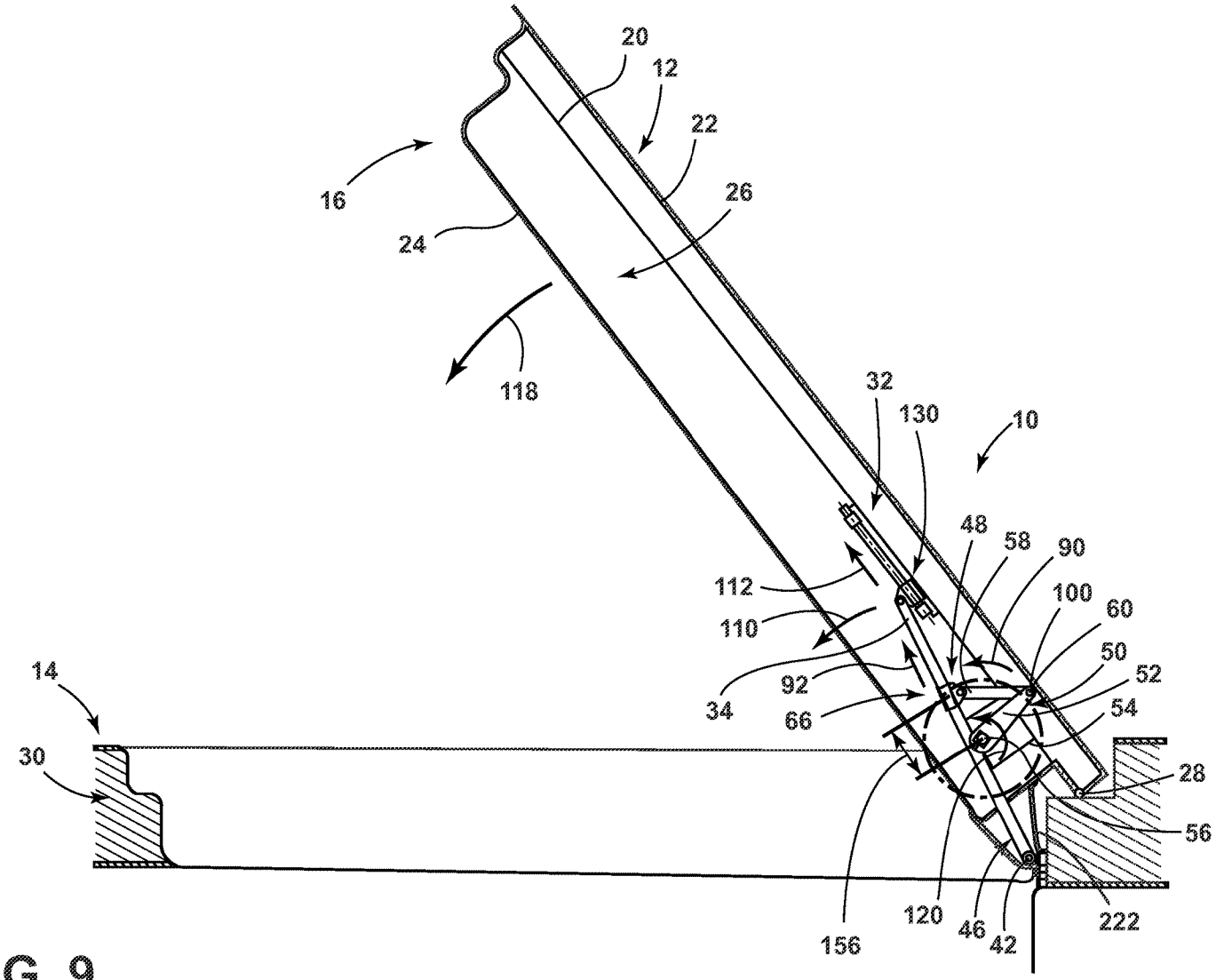
FIG. 9 is a cross-sectional view of the vehicle door of FIG. 2, taken along line IX-IX.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-9, reference numeral 10 generally refers to a multiple slide operator for moving a hinged door 12 for a vehicle 14 between open and closed positions 16, 18, according to at least one embodiment. It is contemplated that a door 12 of a vehicle 14 can include a door frame 20 having an outer panel 22 and an inner panel 24, wherein a door cavity 26 is defined between the outer and inner panels 22, 24 and wherein the door frame 20 is rotationally operable about a door hinge 28 that is coupled to a vehicle frame 30. A first slide 32 of the multiple slide operator 10 is coupled to the door frame 20. A rotating bar 34 is slidably coupled at a first bar end 36 to the first slide 32. The rotating bar 34 is slidably operable along the first slide 32 between a plurality of first slide positions 38. The rotating bar 34 is also operable at a second bar end 40 about a bar hinge 42 between a door-closed position 44 and a door-open position 46. The bar hinge 42 can be coupled to the vehicle frame 30 such that the bar hinge 42 is positioned distal from the door hinge 28. A second slide 48 is at least partially defined by the rotating bar 34. An actuator 50 for the multiple slide operator 10 can include a drive portion 52 that is coupled to a drive mechanism 54. The drive mechanism 54 rotates the actuator 50 about a drive shaft 56. The actuator 50 also includes an idler portion 58 that is rotationally coupled to the drive portion 52 at an actuator pivot 60. It is contemplated that operation of the drive portion 52 slidably operates an actuator end 62 of the idler portion 58 along the second slide 48 between a high-torque position 64 that corresponds to the door-closed position 44 of the rotating bar 34 and a low-torque position 66 that corresponds to the door-open position 46 of the rotating bar 34. In this manner, as the drive mechanism 54 rotates the actuator 50 about the drive shaft 56, the actuator 50 slidably engages the second slide 48 of the rotating bar 34 to operate the rotating bar 34 between the door-closed position 44 and the door-open position 46. The operation of the rotating bar 34 between the door-closed and door-open positions 44, 46 serves to slidably operate the rotating bar 34 along the first slide 32, thereby moving the door 12 between the closed and open positions 18, 16.

Referring again to FIGS. 3-9, when the door 12 is in the closed position 18, and the rotating bar 34 is in the door-closed position 44, the drive portion 52 and idler portion 58 of the actuator 50 are substantially elongated such that the actuator end 62 of the idler portion 58 is positioned at a maximum distance 80 from the drive shaft 56 and the door hinge 28. Moreover, the first bar end 36 of the rotating bar 34 is positioned along the first slide 32 at a first slide position 38 that is a farthest distance 82 from the door hinge 28, with respect to the movement of the first bar end 36 along the first slide 32. Accordingly, the maximum and farthest distances 80, 82 from the door hinge 28 achieved by the actuator end 62 and the first bar end 36, respectively, provide the multiple slide operator 10 with an increased leverage such that operation of the drive mechanism 54 is transferred through the actuator 50 and the rotating bar 34 to points farther from the door hinge 28. In this manner, an increased amount of torque may be delivered from the actuator 50 to the rotating bar 34 and from the rotating bar 34 to the door frame 20 through the use of the first and second slides 32, 48. This increased amount of torque can be helpful in fully closing the door frame 20 against the vehicle frame 30 and causing the door frame 20 to latch to a latching assembly 84 of the door 12 of the vehicle 14, as well as other door-related functions, as will be more fully disclosed below.

Referring again to FIGS. 3-9, as the drive mechanism 54 rotates the drive portion 52 of the actuator 50 about the drive shaft 56, the idler portion 58 of the actuator 50 follows the drive portion 52 and is passively operated about the actuator pivot 60. The idler portion 58, which extends between the actuator pivot 60 and the second slide 48, transfers the rotational actuator movement 90 of the drive portion 52 of the actuator 50 into a sliding actuator movement 92 along the second slide 48. The rotational actuator movement 90 of the drive portion 52 is transferred to the rotating bar 34 from the actuator pivot 60, which pulls or pushes against the rotating bar 34 through the linkage provided by the idler portion 58 of the actuator 50. When the actuator end 62 of the idler portion 58 is disposed in the high-torque position 64, the actuator pivot 60 transfers the rotational actuator movement 90 from the drive mechanism 54 to a portion of the rotating bar 34 farther from the bar hinge 42, such that greater torque can be applied to the rotating bar 34 as the drive portion 52 of the actuator 50 rotates. Typically, higher torque is exerted upon the rotating bar 34 when the door 12 is near the closed position 18. The use of higher torque when the door 12 is near the closed position 18 is effective in slowing the movement of the door 12 when the door 12 is forcibly closed, such as being slammed or inadvertently closed at a substantially high velocity. Such a functionality will be described more fully below.

Referring again to FIGS. 3-9, as the drive portion 52 of the actuator 50 is rotated about the drive shaft 56, the angle of the drive portion 52 with respect to the rotating bar 34 continually changes. This change in the angular relationship between the drive portion 52 of the actuator 50 and the rotating bar 34 is utilized to take advantage of the linkage provided by the idler portion 58 of the actuator 50 to extend between the actuator pivot 60 at the outer end 100 of the drive portion 52 and the second slide 48 of the rotating bar 34. As the drive portion 52 of the actuator 50 changes position with respect to the rotating bar 34, the idler portion 58 rotates about the actuator pivot 60 and forms varying angles with respect to the drive portion 52 of the actuator 50. As the idler portion 58 changes angular positions with respect to the drive portion 52, the rotation of the idler portion 58 about the actuator pivot 60 causes the idler portion 58 to also change angular position with respect to the rotating bar 34. This change in angular position results in the actuator end 62 sliding along the second slide 48 between the high-torque position 64 and the low-torque position 66, thereby transferring the rotational actuator movement 90 into the sliding actuator movement 92 along the second slide 48. Accordingly, as the drive portion 52 of the actuator 50 is rotated about the drive shaft 56, the linkage provided by the idler portion 58 of the actuator 50 gradually increases or decreases the amount of torque exerted by the drive mechanism 54 upon the rotating bar 34 to increase the amount of torque exerted upon the rotating bar 34 as the door 12 nears the closed position 18 and, according to various embodiments, decrease the amount of torque exerted upon the rotating bar 34 as the door 12 reaches the open position 16.

Referring again to FIGS. 3-9, the increased amount of torque that is exerted upon the rotating bar 34 through the linkage of the idler portion 58 between the drive portion 52 of the actuator 50 and the rotating bar 34 can be created when the rotating bar 34 is positioned in the door-closed position 44. This heightened torque is transferred to the door 12 of the vehicle 14 through the linkage between the first bar end 36 of the rotating bar 34 and the first slide 32 that is coupled through a portion of the door 12. The torque supplied by the drive mechanism 54 is further magnified by the rotational bar movement 110 being transferred to a sliding bar movement 112 through the engagement of the first bar end 36 with the first slide 32. Accordingly, the positioning of the first bar end 36 at the far portion 114 of the first slide 32 provides for greater amounts of torque exerted on the door 12 by the rotating bar 34. In turn, when the door 12 is near the closed position 18, the torque exerted by the drive mechanism 54 is amplified through the positioning of the actuator end 62 at the high-torque position 64, and is amplified again through the positioning of the first bar end 36 at the far portion 114 of the first slide 32 with respect to the door hinge 28, which can correspond to a first position of the first slide 32. As such, the inclusion of the first and second slides 32, 48 allow for a dual multiplication of the output torque of the drive mechanism 54 to provide greater opening and closing force 116, 118 upon the door 12, as the door 12 is operated between the open and closed positions 16, 18, in particular, when the door 12 is near the closed position 18. As discussed above, this dual multiplication of torque output from the drive mechanism 54 can be used to slow and/or stop the movement of the door 12 when the door 12 is slammed or inadvertently closed or opened at a high rate of speed, as will be discussed more fully below.

Referring again to FIGS. 3-9, in various embodiments, it is contemplated that the drive mechanism 54 and the drive shaft 56 can be fixed, or substantially fixed, in relation to the door 12 such that when the drive mechanism 54 operates the drive portion 52 of the actuator 50, the rotational force 120 of the drive mechanism 54 is transferred from the drive portion 52 through the linkage provided by the idler portion 58 and into the rotating bar 34 to push or pull the rotating bar 34 relative to the drive mechanism 54. This pushing or pulling force exerted upon the rotating bar 34 by the drive mechanism 54 is transferred to the door 12 through the sliding linkage between the first bar end 36 and the first slide 32. Because the drive mechanism 54 is coupled to the door 12, the effect of this relationship is that the drive mechanism 54 rotates with the door 12 as the door 12 is rotated between the open and closed positions 16, 18. Stated another way, the attachment of the drive mechanism 54 to the door 12 causes the drive mechanism 54 to rotate itself in unison with the door 12 as the door 12 moves between the open and closed positions 16, 18.

In terms of the forces applied by the multiple slide operator 10, according to the various embodiments, when the drive portion 52 of the actuator 50 is rotated away from the rotating bar 34, the drive portion 52 of the actuator 50 pulls against the rotating bar 34 with the force of a certain magnitude. The magnitude of such force can vary depending on the power of the drive mechanism 54, the length of the drive portion 52 of the actuator 50 and other factors. Because of the fixed configuration of the drive mechanism 54 with the door 12, an opposing force is exerted upon the door 12 through the engagement of the drive mechanism 54 with the door 12. These opposing forces, due to the amplification of the torque of the drive mechanism 54 created by the first and second slides 32, 48, result in the rotation of the door 12 between the open and closed positions 16, 18. Accordingly, the effective magnitude of the force exerted on the door 12 at the slidable connection point between the first bar end 36 and the first slide 32 is substantially greater than the opposing force exerted at the connection point between the drive mechanism 54 and the door 12. The resulting forces cause the drive mechanism 54 to effectively move itself with respect to the rotating bar 34 such that the movement of the drive mechanism 54 relative to the rotating bar 34 also moves the door 12 between the open and closed positions 16, 18 relative to the movement of the rotating bar 34 between the door-open position 46 and door-closed position 44.

Referring again to FIGS. 3-9, as discussed above, it is contemplated that the positioning of the actuator 50 with respect to the second slide 48 and the rotating bar 34 with respect to the first slide 32 serves to multiply the rotational force 120, or torque, exerted by the drive mechanism 54 as the actuator end 62 and the first bar end 36 are positioned on the second and first slides 48, 32, respectively, at positions further from the door hinge 28. As the door frame 20 moves toward the open position 16, the actuator end 62 moves along the second slide 48 toward the low-torque position 66 and closer to the door hinge 28 and the first bar end 36 of the rotating bar 34 moves along the first slide 32 to a near position 130 closer to the door hinge 28, which can correspond to a second position at the first slide 32. In this manner, in various embodiments, the amount of torque exerted upon the door frame 20 can decrease, while the speed at which the door 12 operates can, in certain embodiments, increase. It is also contemplated that the speed of the door 12 can remain substantially consistent or consistent as the multiple slide operator 10 moves the door 12 below the open and closed positions 16, 18. It is contemplated that this multiplication of torque resulting from the inclusion of the first and second slides 32, 48 can be accomplished when the drive mechanism 54 is coupled to the frame of the vehicle 14 as well as the door 12. In embodiments where the drive mechanism 54 is coupled to the door 12, such a configuration may result in a more compact system.

Referring again to FIGS. 3-9, it is contemplated that the multiple slide operator 10 can include a first carriage 140 having a first pivot 142, wherein the first carriage 140 is slidably engaged with the first slide 32. In such an embodiment, the first bar end 36 of the rotating bar 34 can engage the first carriage 140 at the first pivot 142 to allow the rotating bar 34 to slidably operate along the first slide 32 between the far position that corresponds to the closed position 18 of the door 12 and the door-closed position 44 of the rotation by the near position 130 that corresponds to the open position 16 of the door 12 and the door-open position 46 of the rotating bar 34. In this manner, the first carriage 140 can provide for an efficient sliding link between the rotating bar 34 and the first slide 32, such that the carriage can receive both the rotational bar movement 110 of the rotating bar 34 with respect to the first slide 32 and the varying and magnified torque forces exerted by the first bar end 36 against the door 12 of the vehicle 14. The first carriage 140 can, at the same time, provide for the sliding bar movement 112 that allows for the sliding engagement between the first bar end 36 and the first slide 32. Accordingly, the first carriage 140 can include various sliding mechanisms that can include, but are not limited to, ball bearings, chains, gearing mechanisms, lubricants, sliding interfaces, combinations thereof, and other similar sliding mechanisms to account for the sliding engagement between the first bar end 36 of the rotating bar 34 and the first slide 32, through the use of the first carriage 140. According to the various embodiments, the first slide 32 and the first carriage 140 can be coupled to various portions of the door 12, including, but not limited to, the outer panel 22, the inner panel 24, a door beam, combinations thereof, or other similar structural member of the door 12 of the vehicle 14.

Referring again to the various embodiments illustrated in FIGS. 3-9, the multiple slide operator 10 can also include a second carriage 150 having a second pivot 152, wherein the second carriage 150 is slidably engaged with the second slide 48. In such an embodiment, the actuator end 62 of the idler arm 202 engages the second carriage 150 at the second pivot 152 to allow the actuator end 62 to slidably operate along a second slide 48 between the high-torque position 64, where the second carriage 150 is the first distance 154 from the door hinge 28, and the low-torque position 66, where the second carriage 150 is a second distance 156 from the door hinge 28, the first distance 154 being greater than the second distance 156. Similar to the first carriage 140, the second carriage 150 can also include similar sliding mechanisms as those described above to account for the sliding actuator 50 of the actuator end 62 along the second slide 48 through the use of the second carriage 150. As with the first carriage 140, the second carriage 150 can also transfer the varying and magnified torque forces of the rotational actuator movement 90 exerted by the drive portion 52 of the actuator 50 to the second slide 48 of the rotating bar 34.

Referring again to FIG. 10, the multiple slide operator 10 can include any one of various operational mechanisms used in conjunction with the door frame 20 as it moves between the open and closed positions 16, 18, and various positions therebetween. One such mechanism can include a soft-close mechanism 170. The soft-close mechanism 170 serves to prevent slamming of the door frame 20 as the user operates the door 12 from the open position 16 towards the closed position 18. Where the user provides a great amount of closing force 118 to move the door 12 from the open position 16 to the closed position 18 (i.e., slamming the door 12), the multiple slide operator 10 can engage at a predetermined angular distance 174 from the closed position 18 to slow the movement of the door frame 20 as it approaches the closed position 18. In such an embodiment, the drive mechanism 54 can be activated when the door frame 20 is at the predetermined angular distance 174 from the closed position 18. The drive mechanism 54, at this predetermined angular distance 174, can activate in an opposing direction to counteract the closing force 118 of the door frame 20 to, at least initially, slow the movement of the door 12. As discussed above, the first and second slides 32, 48 allow for a dual multiplication of the torque or rotational force 120 exerted by the drive mechanism 54. This dual multiplication or amplification, according to various embodiments, can be at its greatest when the door 12 is near the closed position 18 to counteract the heightened closing force 118 exerted by a door 12 that is being slammed into the closed position 18. After the movement of the door 12 is slowed, the drive mechanism 54 can further operate to move the door 12 from a slightly open position 16, such as when the door 12 is ajar, or when the door 12 is at the predetermined angular distance 174 from the closed position 18 and, in a controlled manner, move the door 12 to the closed position 18 through the operation of the drive mechanism 54 and the multiple slide operator 10. According to the various embodiments, the predetermined angular distance 174 that the soft-close mechanism 170 of the multiple slide operator 10 can engage may be within various angular ranges from approximately 1°, which can be a few millimeters from the closed position 18, to approximately 50° in various angular ranges included therebetween.

Figure 10:
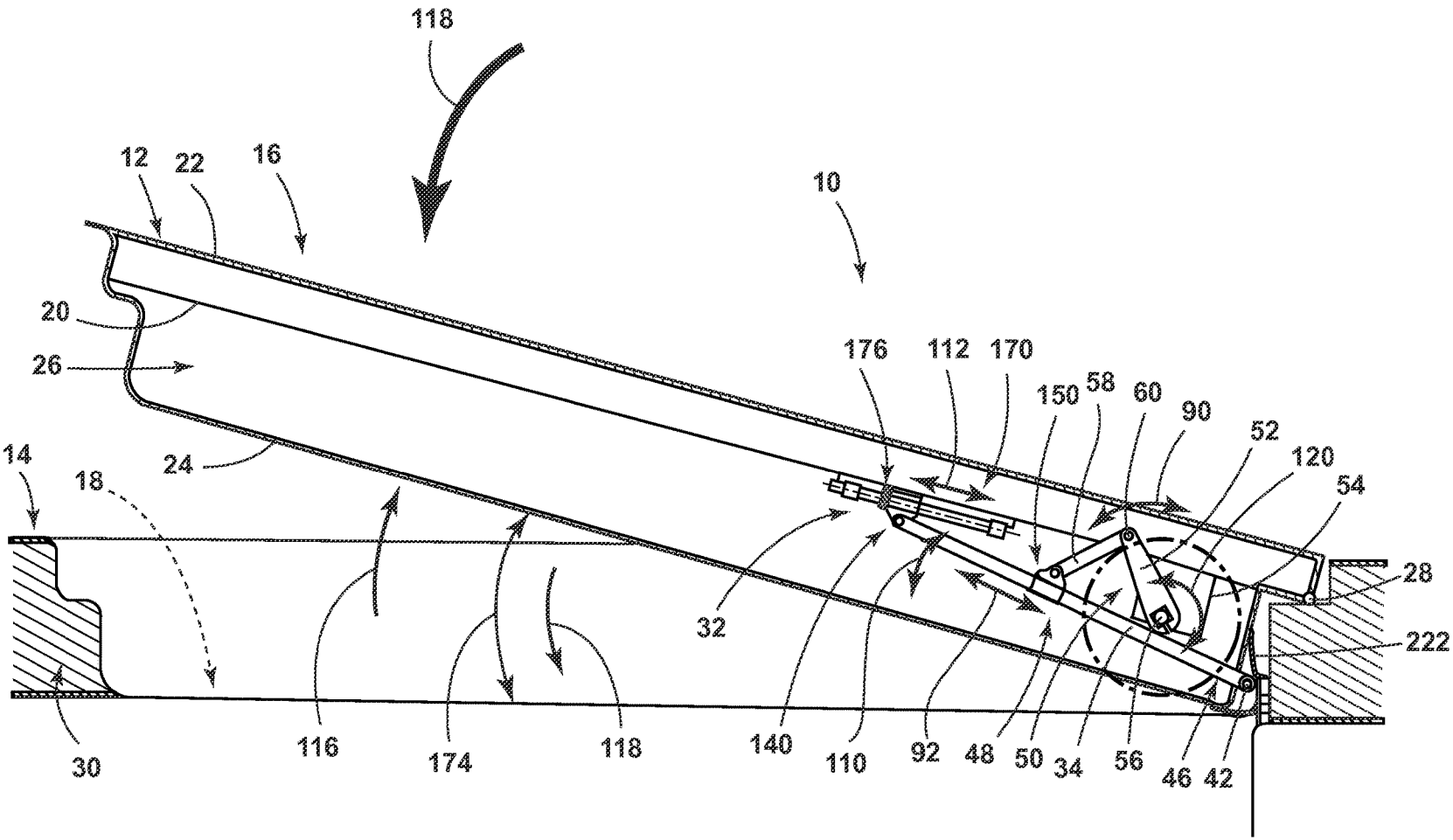
FIG. 10 is an alternate cross-sectional view of the vehicle door of FIG. 5, illustrating an aspect of a soft-close mechanism and a soft-open mechanism.
Figure 11:
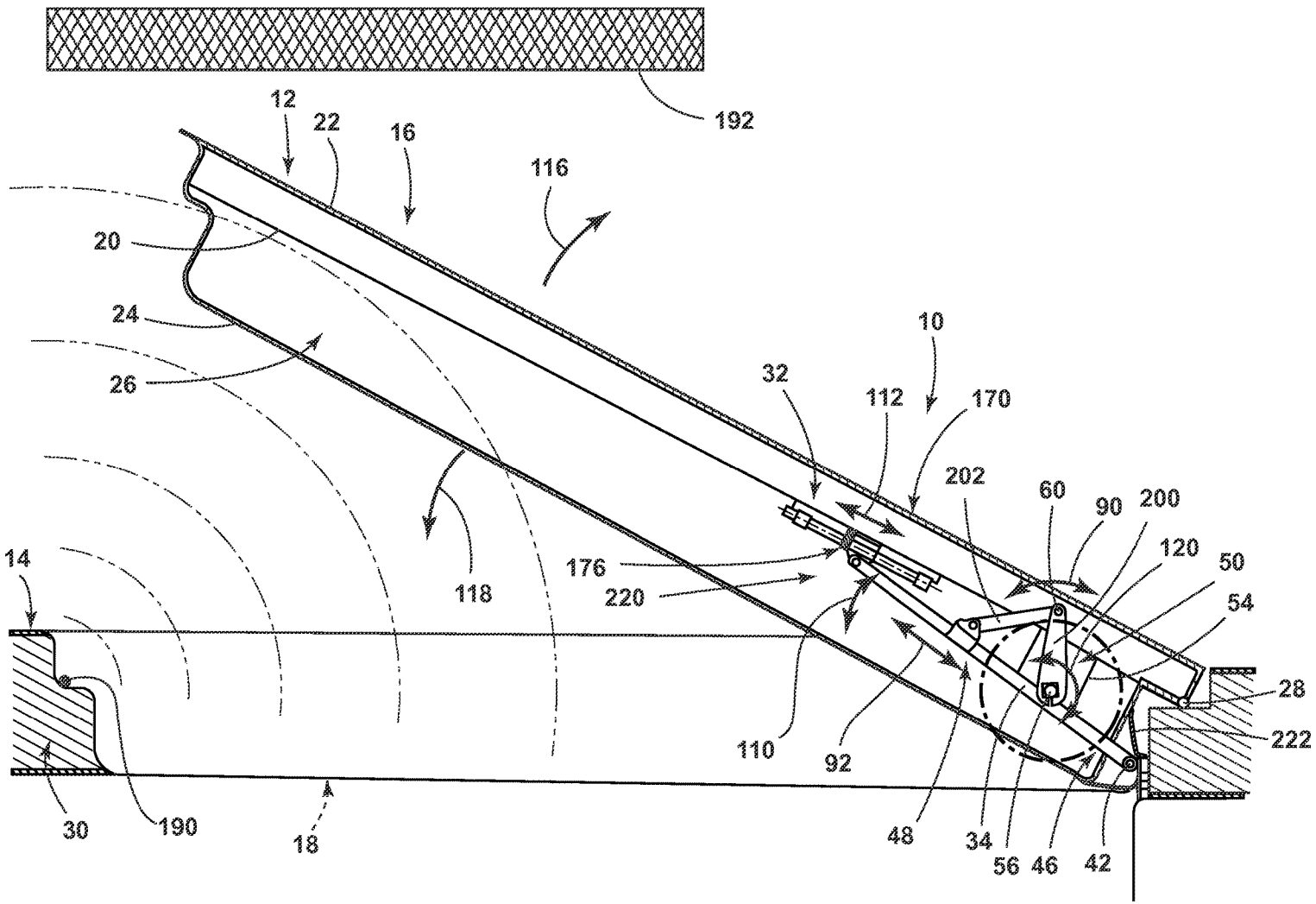
FIG. 11 is an alternate cross-sectional view of the vehicle door of FIG. 5, illustrating an aspect of the multiple slide operator incorporating proximity sensors.

According to various embodiments of the soft-close mechanism 170 incorporated within the multiple slide operator 10, as exemplified in FIGS. 10 and 11, the initial stage of the soft-close mechanism 170 to slow the speed of the door 12 and absorb at least a portion of the closing force 118 can be accomplished through the drive mechanism 54 and/or an alternate operating mechanism 176. Such an alternate operating mechanism 176 can be a damper, pneumatic mechanism, hydraulic mechanism, or other similar mechanism that is configured to slow the rotation of the door 12 between the open and closed positions 16, 18. The alternate operating mechanism 176 can act upon various components of the multiple slide operator 10 to slow the movement of any one or more components of the system. Such components can include, but are not limited to, the first slide 32, first carriage 140, second slide 48, second carriage 150, actuator 50, rotating bar 34, combinations thereof, or other portion of the multiple slide operator 10. Typically, slowing the movement of any one of the components of the multiple slide operator 10 can serve to slow the entire system such that the speed of the door frame 20 can be slowed to a predetermined speed, or stopped altogether. It is contemplated that the accessory operating mechanism can be implemented when the door frame 20 is being closed or opened with an excessive opening force 116 or closing force 118 that may cause damage to the vehicle 14 itself or an adjacent object 192, such as another vehicle.

According to various embodiments, as exemplified in FIG. 11, the drive mechanism 54, or the alternate operating mechanism 176 discussed above, can be implemented in conjunction with one or more proximity sensors 190 disposed upon a portion of the vehicle 14. In various situations, such as where the vehicle 14 is parked next to an adjacent object 192, such as another vehicle, the proximity sensors 190 can serve to activate either the drive mechanism 54 or the alternate operating mechanism 176, or both, to stop the door frame 20 from moving to the open position 16 where a portion of the door 12 may collide with, or otherwise engage, an adjacent or object 192. As the door frame 20 is moved toward the open position 16, the proximity sensor 190 can activate the drive mechanism 54, the alternate operating mechanism 176, or both, to slow the movement of one or more components of the multiple slide operator 10. Accordingly, the multiple slide operator 10 can be operated to prevent opening of the door frame 20 beyond a predetermined angular distance 174, as communicated by the proximity sensor 190, to prevent such unwanted engagement or collision with adjacent objects 192 near the vehicle 14. The multiple slide operator 10 can also be implemented to slow the opening rotational speed, or to decrease the opening force 116, of the door 12 where the door 12 is opened quickly, such as when the vehicle 14 is positioned on a side or downward slope that may cause the inadvertent fast opening of the door 12.

According to the various embodiments, a proximity sensor 190, or other similar sensor, can be positioned to monitor the presence of body parts or other foreign objects 192 between the door 12 in the open position 16 and the vehicle frame 30. In such an embodiment, the proximity sensor 190 can activate to slow or stop the rotation of the door 12 toward the closed position 18, or otherwise decrease the closing force 118 of the door 12, to prevent the door 12 from closing on, pinching, or otherwise engaging the body part or other foreign object 192 between the door 12 and the frame of the vehicle 14.

Referring again to FIGS. 3-12, it is contemplated that the drive portion 52 of the actuator 50 can include a drive arm 200 that is coupled with a drive shaft 56. In such an embodiment, the drive arm 200 can extend linearly from the drive shaft 56 to the actuator pivot 60. Additionally, it is contemplated that the idler portion 58 of the actuator 50 can include an idler arm 202 that extends between the actuator pivot 60 and the second pivot 152 of the second carriage 150 that slidably engages the rotating bar 34. In various alternate embodiments, it is contemplated that the drive portion 52 of the actuator 50 can include a disk, or partial disk, that is rotationally operated by the drive mechanism 54 about the drive shaft 56. In this embodiment, the disk can include the actuator pivot 60 from which the idler portion 58 can extend to engage the second pivot 152 of the second carriage 150.

Referring again to FIGS. 3-12, it is contemplated that the second carriage 150 can slide directly along a portion of the rotating bar 34. It is also contemplated that the rotating bar 34 can include a separate second slide 48 that is positioned adjacent to the rotating bar 34 such that the second carriage 150 can slide along the second slide 48, and the second slide 48 can provide additional structural support to the rotating bar 34 as it moves between the door-closed position 44 and the door-open position 46.

According to the various embodiments, it is contemplated that the drive mechanism 54 can include any one of various motors or rotating mechanisms that can include, but are not limited to, an electrical motor, a pneumatic drive, a hydraulic drive, a one-way motor, a two-way motor, combinations thereof, and other similar drive mechanisms 54.

Figure 12:
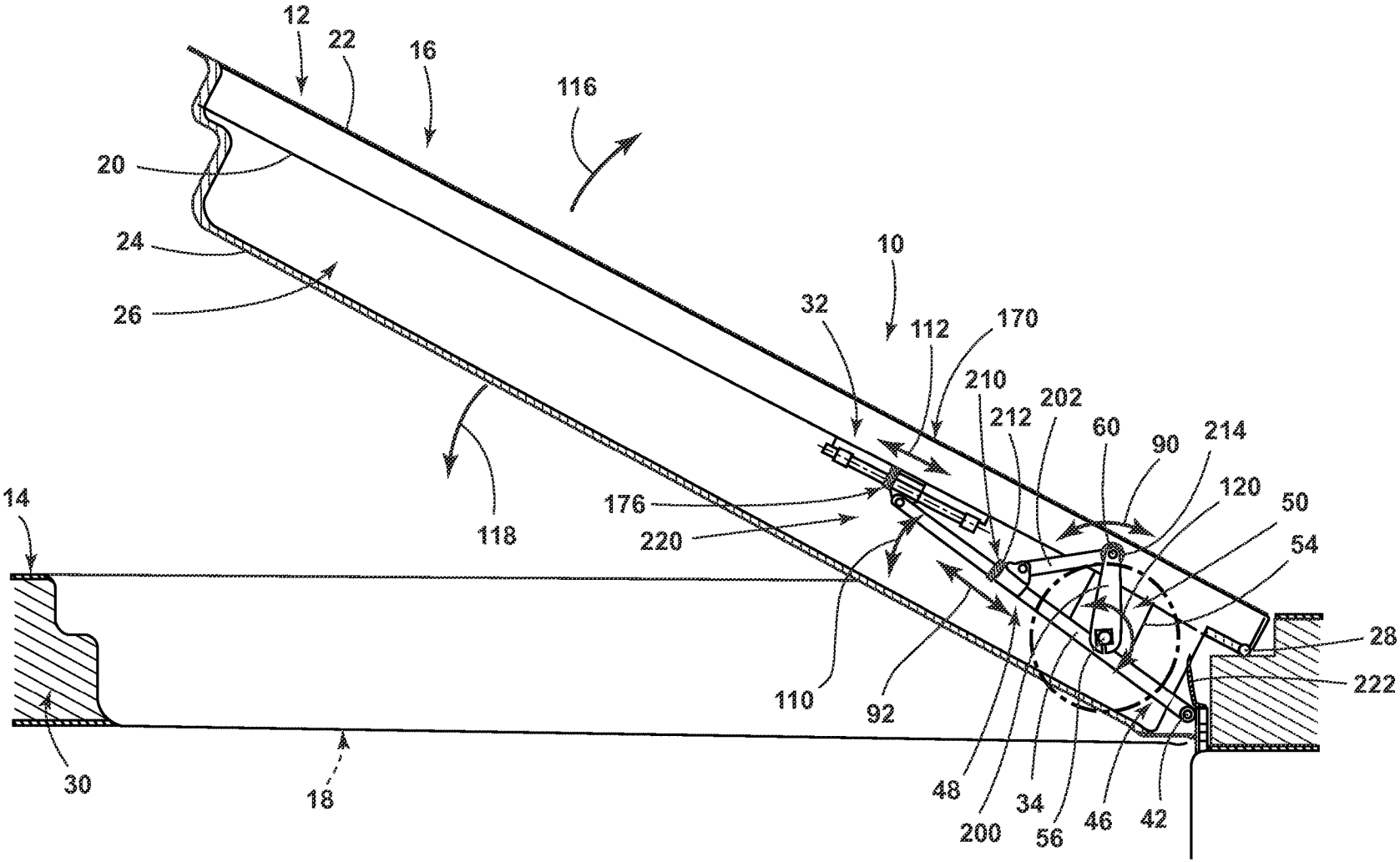
FIG. 12 is an alternate cross-sectional view of the vehicle door of FIG. 5 illustrating an aspect of a speed-limiting mechanism of an aspect of the multiple slide operator.

As discussed above, with reference to the various embodiments exemplified in FIGS. 10-12, the alternate operating mechanism 176 can be used for slowing the rotational speed of the door 12 between the open and closed positions 16, 18, or otherwise decreasing the opening and/or closing force 116, 118 of the door 12. In this manner, the multiple slide operator 10 can include a speed-limiting mechanism 210 that is coupled to at least one of the first slide 32, the second slide 48, first or second carriage 140, 150, the actuator 50 and the drive shaft 56. In such an embodiment, the speed-limiting mechanism 210 serves to limit the rotational speed of the door 12 about the door hinge 28 between open and closed positions 16, 18 of the door 12. In this manner, where the speed-limiting mechanism 210 is disposed on the first and/or second slides 32, 48, the speed-limiting mechanism 210 can be a linear mechanism 212 that activates where the speed of the first and/or second slide 32, 48 exceeds a predetermined sliding rate and/or where the opening or closing forces 116, 118 exceed a predetermined force limit. By way of example, and not limitation, when a door 12 is rotated at a high rate toward the open or closed positions 16, 18, one or more of the first and second carriages 140, 150 may move along the first and second slides 32, 48, respectively, at an accelerated rate of speed. The speed-limiting mechanism 210 engaged to the first and/or second carriages 140, 150 can serve to activate once the first and/or second carriages 140, 150 exceed this predetermined maximum speed. The speed-limiting mechanisms 210 can activate to decrease the speed of the first and/or second carriages 140, 150, or prevent further increase in speed, as they slide across the first and second slides 32, 48, respectively.

According to the various embodiments, where the speed-limiting mechanism 210 is disposed on the drive shaft 56, or one of the pivots of the multiple slide operator 10, it is contemplated that the speed-limiting mechanism 210 can be disposed on the drive shaft 56 itself or can be incorporated within the drive mechanism 54 to prevent rotation of the drive portion 52 of the actuator 50 beyond a predetermined rotational speed. Where such excessive speed is achieved, the speed-limiting mechanism 210 can activate as a rotational governor 214 to limit the rotational speed of the drive portion 52 of the actuator 50. It is also contemplated that the speed-limiting mechanism 210 can serve to activate the drive mechanism 54 to provide power in the opposing rotational direction, where the rotation of the drive mechanism 54 serves to counteract the movement of the drive portion 52 of the actuator 50 as the door 12 is moved at an excessive rate of speed from the closed position 18 to the open position 16 or vice versa. The speed-limiting mechanism 210 can also be a damper or piston-type device that limits the rotational speed of one member of the multiple slide operator 10 relative to another. Such a speed-limiting mechanism 210 could be disposed between the drive and idler portions 52, 58 of the actuator 50. Such a speed-limiting mechanism 210 can also be positioned proximate one of the hinges or pivot points of the multiple slide operator 10.

According to the various embodiments, once the speed-limiting mechanism 210 activates to slow the speed of the door 12 between the open and closed positions 16, 18, and/or decrease the opening or closing force 116, 118 of the door 12, the drive mechanism 54 of the multiple slide operator 10 can activate to move the door 12 toward the desired position at a predetermined rotational rate to provide a soft-open mechanism 220 or soft-close mechanism 170 to operate the door 12 between the open and closed positions 16, 18.

Referring again to the various embodiments illustrated in FIGS. 3-12, the multiple slide operator 10 can also include the door 12 having the first slide 32 and the rotating bar 34 that defines the second slide 48 and extends between the vehicle frame 30 and the first slide 32. In such an embodiment, the actuator 50 can be a multi-part actuator 50 and can be coupled with the drive mechanism 54, wherein rotation of the actuator 50 causes an actuator end 62 of the actuator 50 to slide along the second slide 48, thereby causing the rotating bar 34 to rotate and slide along the first slide 32 to rotate the door 12 about the door hinge 28. As discussed above, the multiple slide operator 10 can include various functionalities that can include, but are not limited to, a soft-close mechanism 170, a soft-open mechanism 220, a speed-limiting mechanism 210, a rotational limiting mechanism operated in conjunction with a proximity sensor 190, a full range door operator, a full range door closer, as well as others. One such other functionality can include a fixed door position functionality. In such an embodiment, the user can select a predetermined angular distance 174 or position of the door 12, relative to the closed position 18, to remain locked in, or substantially locked in, as the user enters and/or exits the vehicle 14. Such a functionality can be implemented to lock the multiple slide operator 10 in a fixed position to allow the occupant of the vehicle 14 to utilize the door 12 as a support device as they enter or exit the vehicle 14. When selected, a locking mechanism contained within a portion of the multiple slide operator 10, or multiple portions thereof, can be engaged to prevent movement of one or more of the components that can include, but are not limited to, the first carriage 140, the second carriage 150, the drive shaft 56, the actuator 50, or other portion of the multiple slide operator 10. The locking mechanism can also be engaged or disengaged by the drive mechanism 54 and/or the alternate operating mechanism 176.

According to the various embodiments, it is contemplated that the multiple slide operator 10 can also include the rotating bar 34 that is coupled with the door 12 at the first carriage 140, which is operable along the first slide 32 between the door-closed and the door-open positions 44, 46. In such an embodiment, the actuator 50 can operably extend between the door 12 and the second carriage 150, where the second carriage 150 is slidably operable along the rotating bar 34 between the high-torque position 64 that corresponds to the door-closed position 44 and the low-torque position 66 that corresponds to the door-open position 46. According to the various embodiments, the high-torque position 64 of the second carriage 150 can be further defined by the actuator 50 being in a substantially linear position. Stated another way, in the high-torque position 64, a drive portion 52 and the idler portion 58 of the actuator 50 can define a substantially linear member extending from the drive shaft 56 to the second slide 48. Once the drive mechanism 54 is actuated, the drive portion 52 of the actuator 50 begins to rotate such that the idler portion 58 of the actuator 50 rotates about the actuator pivot 60 to follow the drive portion 52 of the actuator 50 as the drive portion 52 is rotated about the drive shaft 56. According to the various embodiments discussed above, the operation of the multiple slide operator 10 is configured such that operation of the drive portion 52 of actuator 50 about the drive shaft 56 can be, in various embodiments, limited to a finite rotational range. In such embodiments, the finite rotational range of the drive portion 52 of the actuator 50 substantially prevents the drive portion 52 and idler portions 58 of the actuator 50 from crossing over one another. In such a situation, according to various embodiments, it may be difficult for the drive portion 52 of the actuator 50 to push the idler portion 58 of the actuator 50 in such a fashion so as to move the second carriage 150 from the low-torque position 66 to the high-torque position 64. In various alternate embodiments, it is contemplated that the drive portion 52 and idler portion 58 of the actuator 50 can be sized to allow the drive portion 52 to rotate 360° about the drive shaft 56. In such an embodiment, the drive mechanism 54 can be a one-way motor that operates in a single direction to operate the door 12 between the open and closed positions 16, 18.

According to the various embodiments, it is contemplated that the entire multiple slide operator 10, or a majority of the multiple slide operator 10, can be contained within the door cavity 26 defined between the outer panel 22 and inner panel 24 of the door 12. Accordingly, the space required to contain the multiple slide operator 10 as well as space for the operation of the multiple slide operator 10 can be substantially minimized. It is contemplated that although the space needed for housing the multiple slide operator 10 can be minimized, the torque output provided by the multiple slide operator 10 may not be diminished due to the multiplication of the output torque of the drive mechanism 54 provided by the first and second slides 32, 48. Where portions of the multiple slide operator 10 extend between the door cavity 26 and the vehicle frame 30, such as the rotating bar 34, a gasket 222 can be incorporated into a portion of the door 12 to at least partially conceal portions of the multiple slide operator 10 extending from the door cavity 26.

According to the various embodiments, it is contemplated that the multiple slide operator 10 can be used within doors 12 of varying sizes such as smaller sedan doors to larger coupe doors or doors on pick-up trucks and SUVs. It is also contemplated that the multiple slide operator 10 can also be used in rotational cargo doors such as those on larger SUVs, cargo vans and similar passenger and cargo vehicles.

According to the various embodiments, the multiple slide operator 10 can be used to operate the door 12 from the closed position 18 to the open position 16, where the open position 16 can be up to approximately 62° or more away from the closed position 18. When moving through this path of travel, it is contemplated that the rotating bar 34 of the multiple slide operator 10 is a substantially rigid member that is capable of withstanding forces exerted upon it by the actuator 50, as well as the vehicle door 12, in particular with respect to the soft-close and soft-open functions described above.

The torque multiplication utilized within the multiple slide operator 10 can be roughly three times, or more, the average torque of the motor and at roughly one third, or less, of the motor speed. This torque-to-motor-speed ratio can allow for good positioning control of the door 12 as it operates between the open and closed positions 16, 18. This ratio also provides for the ability of the multiple slide operator 10 to perform the soft-open and soft-closed functionalities capable through use of the multiple slide operator 10.

It is contemplated that the operation of the multiple slide operator 10, as described above, can serve to limit the amount of hysteresis and backlash such that motion of the multiple slide operator 10 is smooth. Additionally, the operation of the components of the multiple slide operator 10 can be linearly proportional to the speed of the drive mechanism 54 or substantially linearly proportional thereto.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door assembly comprising:

a vehicle door having an outer panel and an inner panel, wherein a door cavity is defined between the outer and inner panels, and wherein the vehicle door is rotationally operable about a door hinge coupled to a vehicle frame;

a first slide coupled to a portion of the vehicle door;

a rotating bar slidably coupled at a first bar end to the first slide between a plurality of first slide positions and operable at a second bar end about a bar hinge between door-closed and door-open positions, wherein the bar hinge is coupled to the vehicle frame and positioned distal from the door hinge;

a second slide at least partially defined by the rotating bar; and an actuator having a drive portion coupled to a drive mechanism that rotates the actuator about a drive shaft, wherein the actuator also includes an idler portion rotationally coupled to the drive portion at an actuator pivot, wherein operation of the drive portion slidably operates an actuator end along the second slide between a high-torque position that corresponds to the door-closed position of the rotating bar and a low-torque position that corresponds to the door-open position of the rotating bar.

2. The vehicle door assembly of claim 1, wherein the drive shaft is coupled to the vehicle door and is positioned distal from the door hinge and the bar hinge.

3. The vehicle door assembly of claim 1, further comprising:

a first carriage having a first pivot, wherein the first carriage is slidably engaged with the first slide, wherein the first bar end of the rotating bar engages the first carriage at the first pivot to allow the rotating bar to slidably operate along the first slide between a first position that corresponds to a closed position of the vehicle door, and a second position that corresponds to an open position of the vehicle door.

4. The vehicle door assembly of claim 3, further comprising:

a second carriage having a second pivot, wherein the second carriage is slidably engaged with the second slide, wherein the actuator end of the idler portion engages the second carriage at the second pivot to allow the actuator end to slidably operate along the second slide between the high-torque position, wherein the second carriage is a first distance from the door hinge, and the low-torque position, wherein the second carriage is a second distance from the door hinge, the first distance being greater than the second distance.

5. The vehicle door assembly of claim 4, wherein the second carriage slides along the rotating bar to define the second slide.

6. A vehicle door operator comprising:

a door having a first slide;

a rigid rotating bar defining a second slide and extending between a vehicle frame and the first slide;

an actuator coupled with a drive mechanism having a drive shaft, wherein rotation of the actuator causes an end of the actuator to slide along the second slide thereby causing the rotating bar to rotate and slide along the first slide to rotate the door about a door hinge positioned distal from the rotating bar, and wherein the drive mechanism selectively operates the actuator about the drive shaft to rotate the drive mechanism, actuator and drive shaft with the door about the door hinge, wherein the drive shaft is distal from the door hinge, and a speed-limiting mechanism coupled to at least one of the first slide, the second slide and the drive shaft, wherein the speed-limiting mechanism limits rotational speed of the door about the door hinge between open and closed positions of the door.

7. The vehicle door operator of claim 6, wherein the rotating bar rotates about a bar hinge coupled to the vehicle frame, and wherein the bar hinge is positioned distal from the door hinge.

8. The vehicle door operator of claim 6, wherein the actuator is a multi-part actuator having a drive portion and an idler portion, wherein as the drive mechanism operates the drive portion of the multi-part actuator, the drive portion operates the idler portion to slidably cooperate with the second slide to operate the rotating bar.

9. The vehicle door operator of claim 8, wherein the drive portion is a disk that is rotated by the drive mechanism, wherein the disk includes an actuator pivot around which the idler portion rotates.

10. The vehicle door operator of claim 6, wherein the actuator includes a drive arm coupled with the drive shaft and an idler arm coupled with the drive arm at an actuator pivot, wherein the idler arm extends between the actuator pivot and the second slide, and wherein the drive mechanism and the actuator are coupled to the door.

11. The vehicle door operator of claim 10, further comprising:

a first carriage having a first pivot, wherein the first carriage is slidably engaged with the first slide, wherein the rotating bar engages the first carriage at the first pivot to allow the rotating bar to slidably operate along the first slide between a first position that corresponds to a closed position of the door, and a second position that corresponds to an open position of the door; and a second carriage having a second pivot, wherein the second carriage is slidably engaged with the second slide, wherein the idler arm engages the second carriage at the second pivot to allow the end of the actuator to slidably operate along the second slide between a high-torque position, wherein the second carriage is a first distance from the door hinge, and a low-torque position, wherein the second carriage is a second distance from the door hinge, the first distance being greater than the second distance.

* * * * *